US007231733B2

(12) United States Patent
Regelin

(10) Patent No.: US 7,231,733 B2
(45) **Date of Patent: *Jun. 19, 2007**

(54) DISPLAY FRAME

(76) Inventor: Larry Regelin, 14300 Orchard Rd., Minnetonka, MN (US) 55435

( * ) Notice: Subject to any disclaimer, the term of this patent is extended or adjusted under 35 U.S.C. 154(b) by 174 days.

This patent is subject to a terminal disclaimer.

(21) Appl. No.: 11/083,521

(22) Filed: Mar. 18, 2005

(65) Prior Publication Data

US 2005/0160653 A1 Jul. 28, 2005

Related U.S. Application Data

(63) Continuation-in-part of application No. 10/632,161, filed on Aug. 1, 2003, now Pat. No. 6,898,879.

(51) Int. Cl.
*G09F 19/00* (2006.01)
*E01F 9/011* (2006.01)

(52) U.S. Cl. ..... 40/124.5; 52/103

(58) Field of Classification Search ..... 40/124.5; 52/103

See application file for complete search history.

(56) References Cited

U.S. PATENT DOCUMENTS 5,430,965 A * 7/1995 Lai ..... 40/597
6,898,879 B2 * 5/2005 Regelin ..... 40/124.5

* cited by examiner

*Primary Examiner*—S. Joseph Morano
*Assistant Examiner*—Robert J. McCarry, Jr.
(74) *Attorney, Agent, or Firm*—Jacobson and Johnson

(57) ABSTRACT

A display device made of transparent flexibly resilient plastic having a pair of nestable members forming a weather resistant framed area for holding flat planar display material such as a photograph or memorabilia or advertising material or the like.

20 Claims, 7 Drawing Sheets

DISPLAY FRAME

This application is a continuation-in-part of U.S. application Ser. No. 10/632,161 filed Aug. 1, 2003 now U.S. Pat. No. 6,898,879.

FIELD OF THE INVENTION

This invention is aimed at providing a durable display frame for holding a flat or planar display such as a photograph or memorabilia or advertisements and the like. More specifically, it is a display frame made out of flexibly resilient clear polymer plastic with the display material secured in a framed area between two similar nested members.

BACKGROUND OF THE INVENTION

There are a number of prior art devices for holding photographs and the like in the form of ordinary picture frames and there are a number of prior art devices for placing signs, such as real estate signs or outdoor sale signs, upright using a stake or post inserted into the ground. These devices usually are made out of a combination of different materials. Some have members or attachments to protect the sign against weather elements and some are constructed so that the content of the sign can be changed from time to time.

SUMMARY OF THE INVENTION

A pair of substantially similar nestable members are made out of flexibly resilient transparent plastic such as PVC, each member having a fairly shallow cavity defined by a generally planar face or floor surrounded by an enclosing upstanding wall. Preferably the face has a surrounding area which is dimensioned with respect to the surrounding wall to define a framed area in which flat or planar display material such as a photograph or memorabilia or the like is placed for display. The frame area may be made by a slight indentation of part of the face. One member is nested snugly within the cavity of the other member with the respective faces in close proximity to securely hold the members together and to hold the display material in place between them. In one embodiment a pointed stake extends out from an edge of one of the members for insertion into the ground to hold the display frame upright for use as a marker at a gravesite. Preferably a flange extends completely around each of the members extending outward from the walls which surround the cavities. The overlapping flanges in combination with the nesting of the members serves as a further barrier to help seal off the interior area to protect against damage from the weather. The two members can be disengaged or pulled apart if desired to remove and/or replace the display material and then renested.

In one embodiment the members are made integral with one another out of a single sheet of plastic with the two members joined together along an edge by a living hinge. Alternatively, the two nestable members may be separable from one another, i.e., without the living hinge.

BRIEF DESCRIPTION OF THE DRAWINGS

FIG. 5 is a side view illustrating another embodiment of the invention as a gravesite marker or the like;

DESCRIPTION OF THE PREFERRED EMBODIMENTS

With reference to the embodiment illustrated in FIGS. 1–4, a pair of substantially similar members 10A and 10B are formed of flexibly resilient transparent polymer plastic such as PVC by a conventional thermal-forming process. Each of the members has a cavity, 11A and 11B, respectively, defined by a generally planar face or floor 12A and 12B, respectively, surrounded by an upstanding wall 13A and 13B, respectively. In the illustrated embodiments the respective cavity faces 12A and 12B each have a very slight indentation 14A and 14B, respectively, defining a surrounding frame area 15A and 15B, respectively, with their corresponding cavities' surrounding walls 13A and 13B. Extending outward from the edge of each of the respective surrounding walls parallel to the cavity faces are enclosing flanges 17A and 17B, respectively. Attached to and formed integrally with an edge of one of the members, for example, 10B is a pointed arrow-like stake 18. In one embodiment, illustrated in FIGS. 1–4, members 10A and 10B are made out of a single sheet or layer of plastic joined together by an integrally formed living hinge 20 at an edge of the respective flanges.

Figure 11:
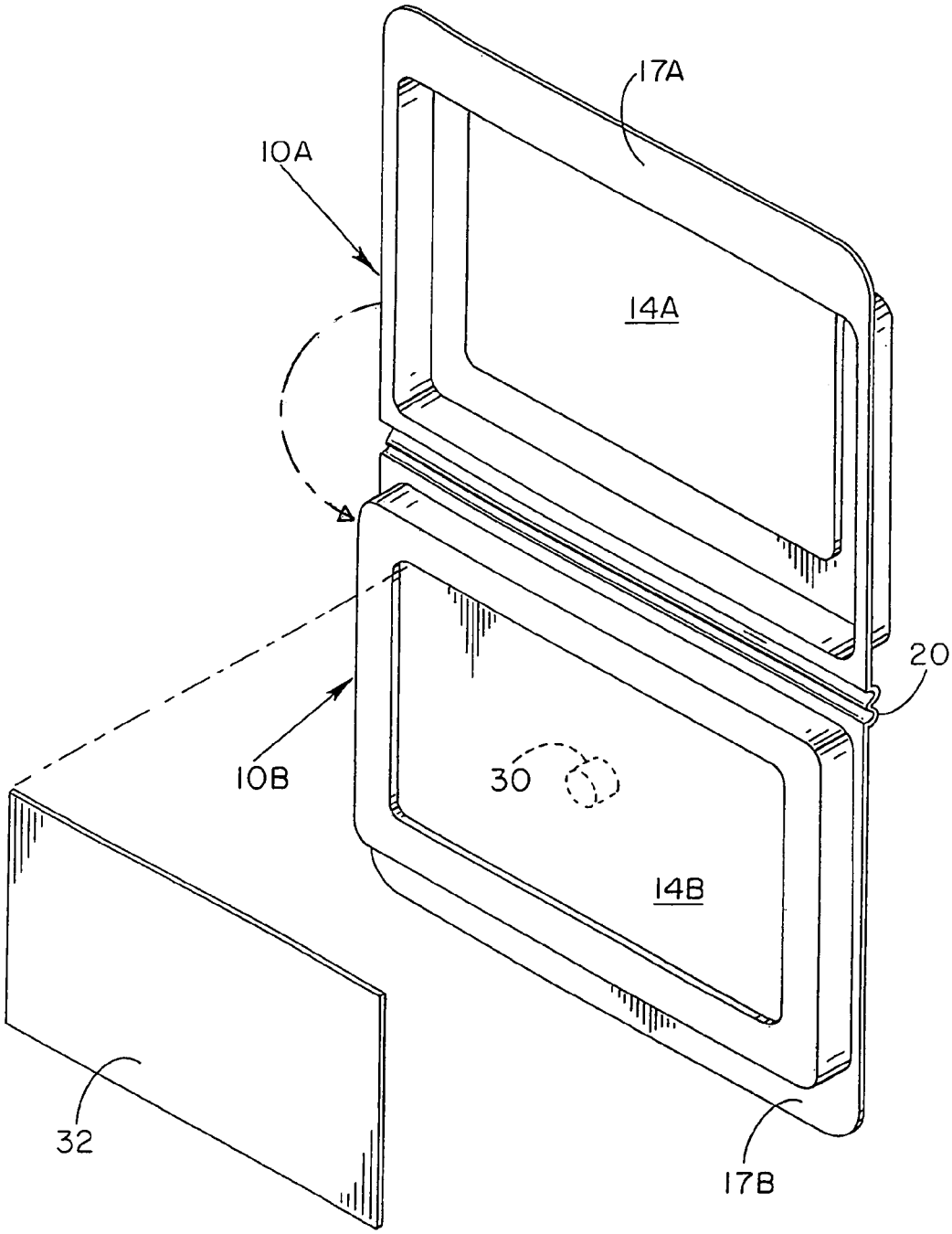
FIG. 11 is a blow-apart somewhat functional illustration.

In practice, as illustrated for example in FIG. 11, flat or planar display material 32 may be placed within the framed area 15 of one of the members and then the two members are nested together to firmly hold the display material between the faces 12A and 12B. The members are dimensioned and the materials of which they are made are such that one member, e.g., 10B, will nest snugly in the cavity of the other member, e.g., 11A, to hold the display material firmly between the two faces 12A and 12B. The snug fit between the side walls 13A and 13B not only serves to hold the two members securely together and the display material firmly in place but also provides a barrier or protective shield against weather elements. In addition the overlap of the flanges 17A and 17B may serve as a further barrier to prevent weather elements from reaching the interior. In one embodiment a stake 18 may be formed as part of the display frame for insertion into the ground adjacent a gravesite to hold the display frame upright in place. If desired, the display frame can be removed from the ground and the two members 10A and 10B disengaged or pulled apart and the display removed and replaced in the manner as described above.

Typically, with no limitation intended, a display frame made according to the teachings of the invention is made of 0.030 in. clear PVC, an outer width (including flange 17) of about 6.25 in., a depth of cavity 11 about 0.38 in., the width of the frame 15 about 0.5 in., the depth of the shallow indentation about 0.08 in. and the dimension of the framed area about 3 in. by 5 in. to hold a conventional 3×5 photograph.

Figure 1:
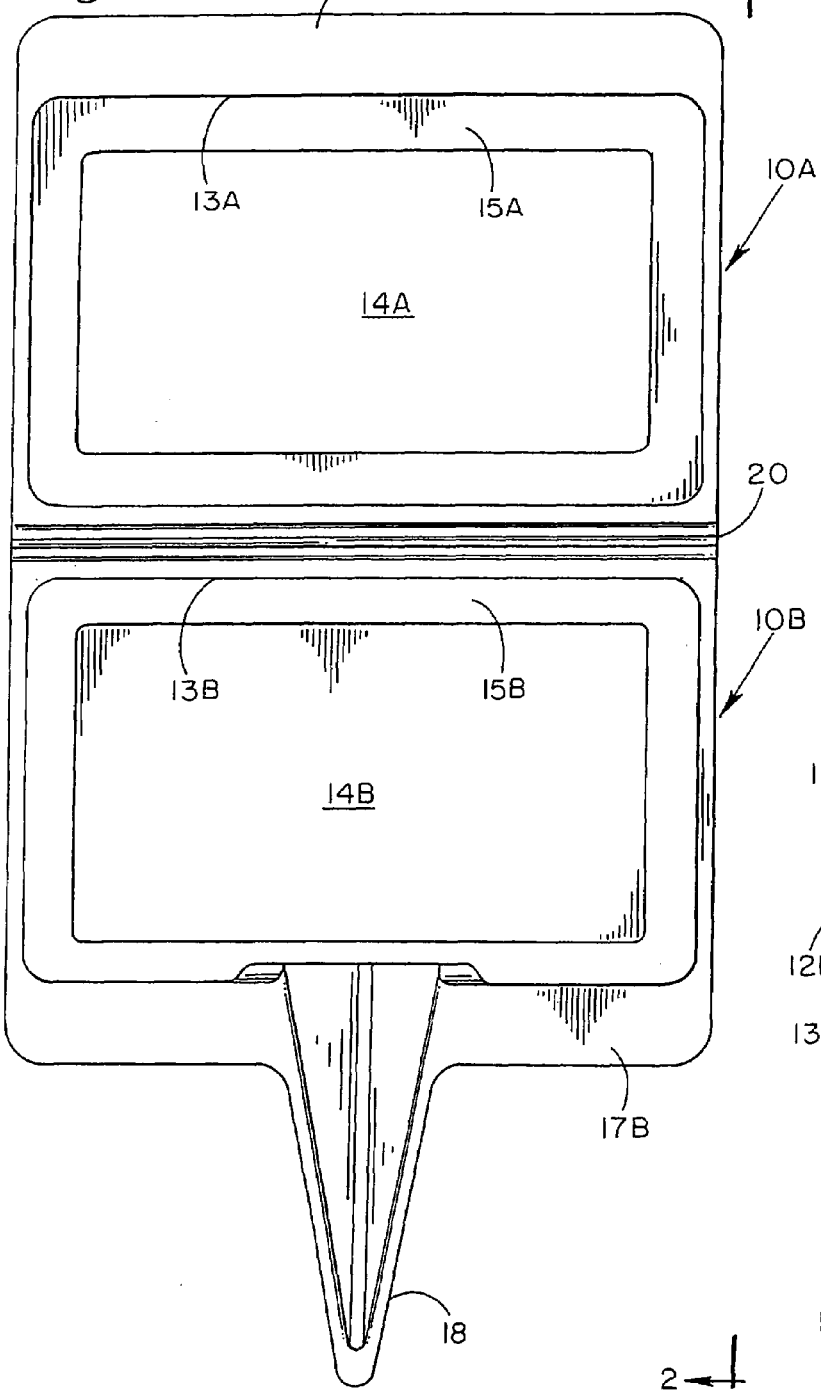
FIG. 1 can be considered a plan or front view of an embodiment of the invention as a gravesite marker or the like in the open condition.
Figure 2:
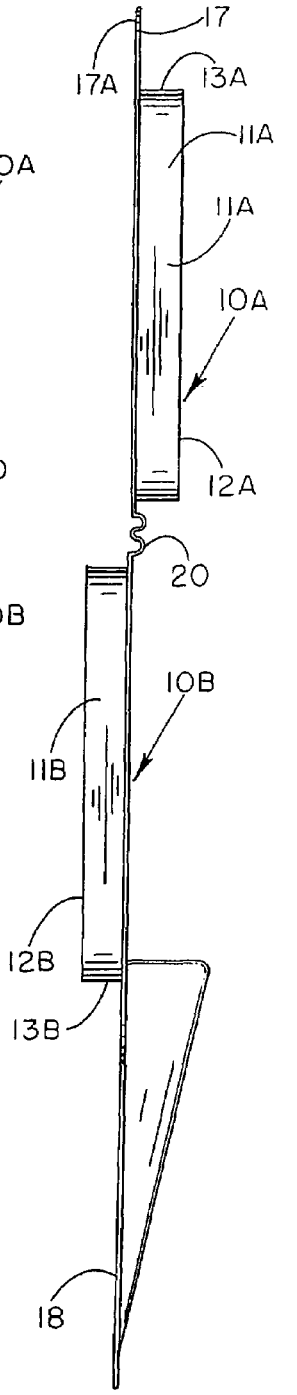
FIG. 2 is a side view of FIG. 1.
Figure 3:
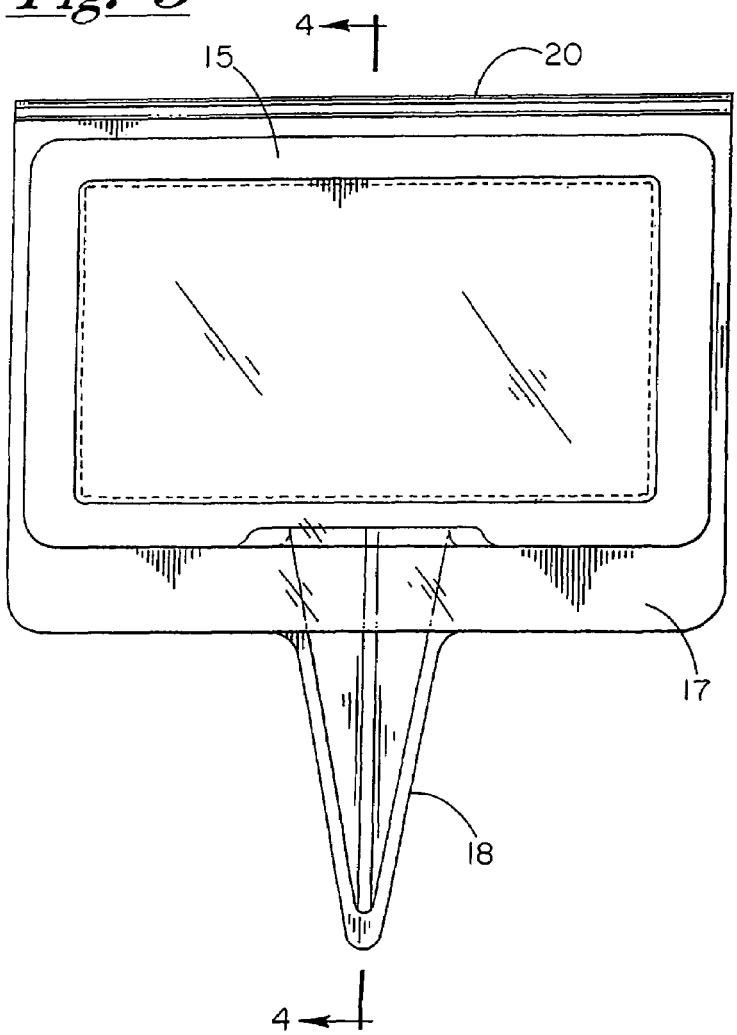
FIG. 3 is a plan or front view showing the embodiment of FIG. 1 in closed or use position.
Figure 4:
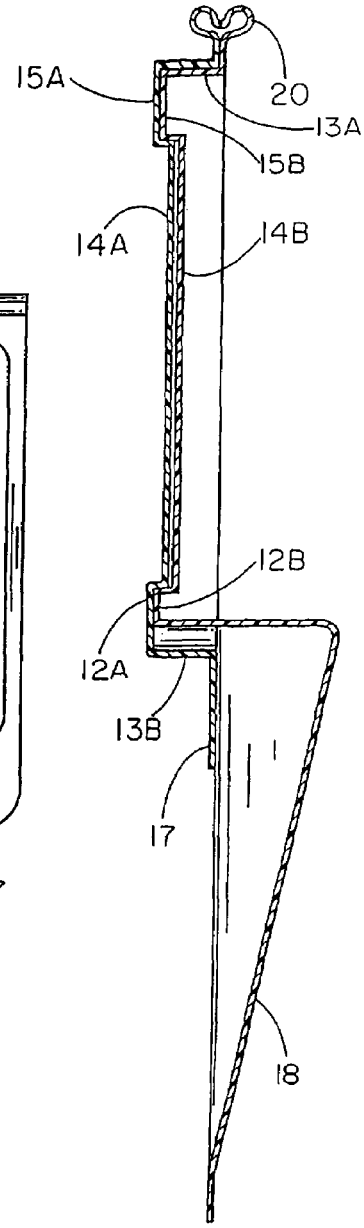
FIG. 4 is a sectioned view of FIG. 3.
Figure 5:
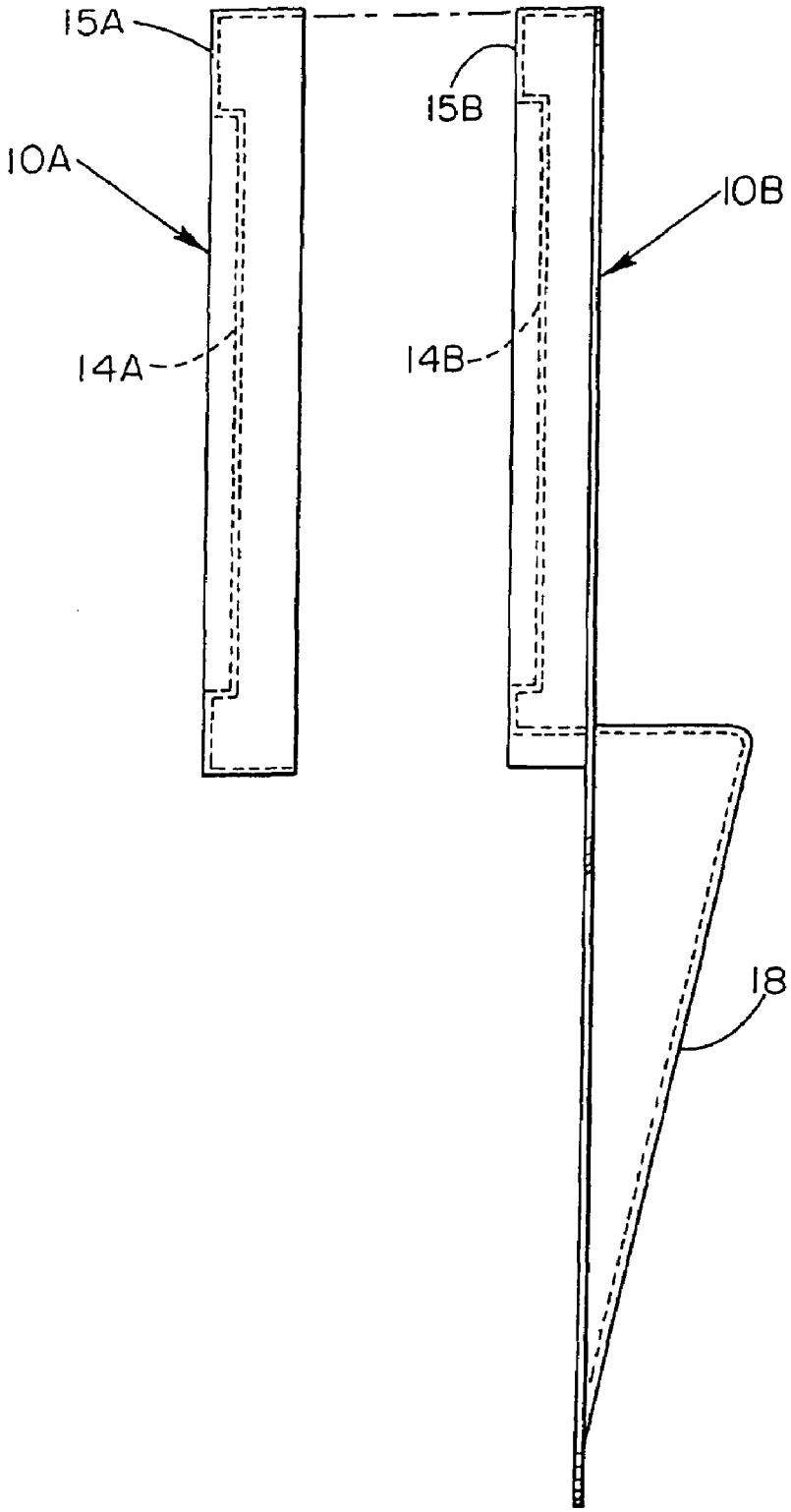
Figure 6:
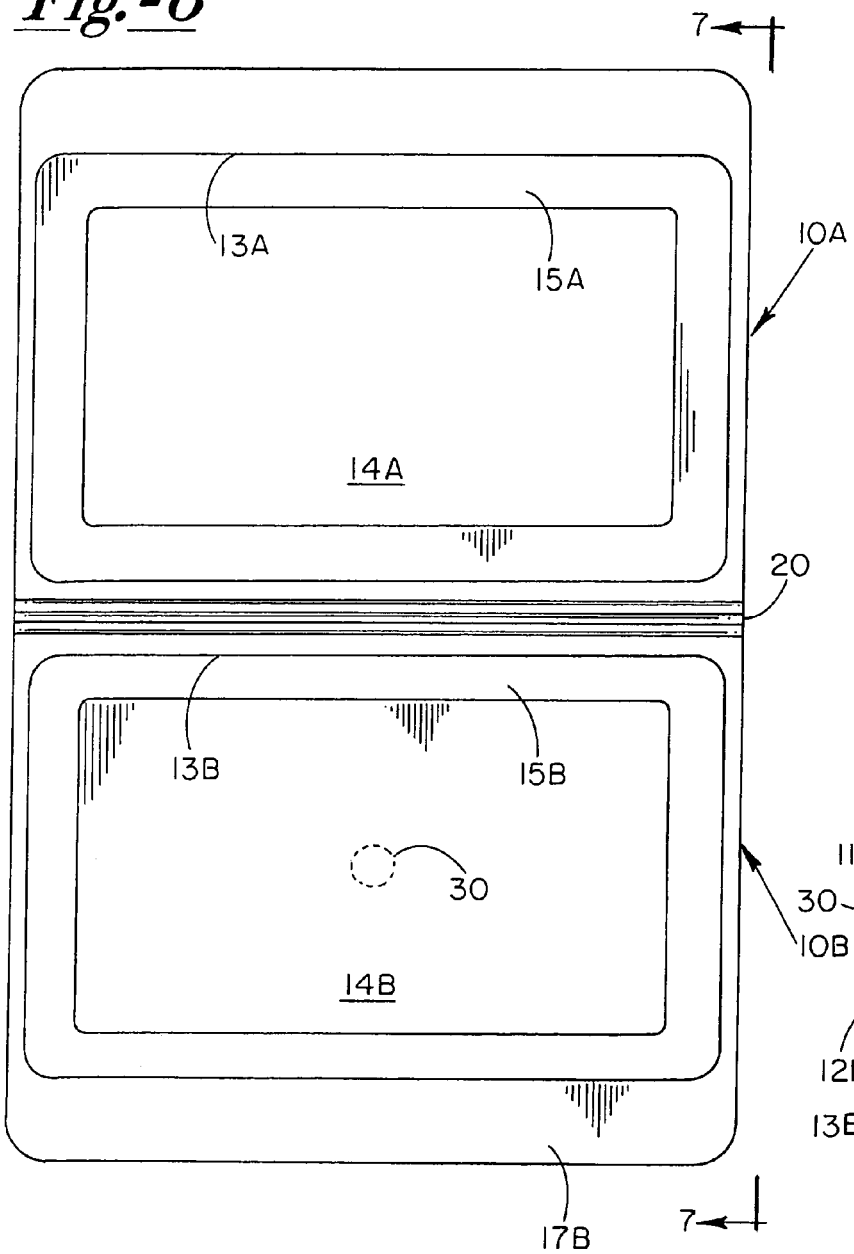
FIG. 6 is a plan or front view of an embodiment of the invention other than as a gravesite marker in the open condition.
Figure 7:
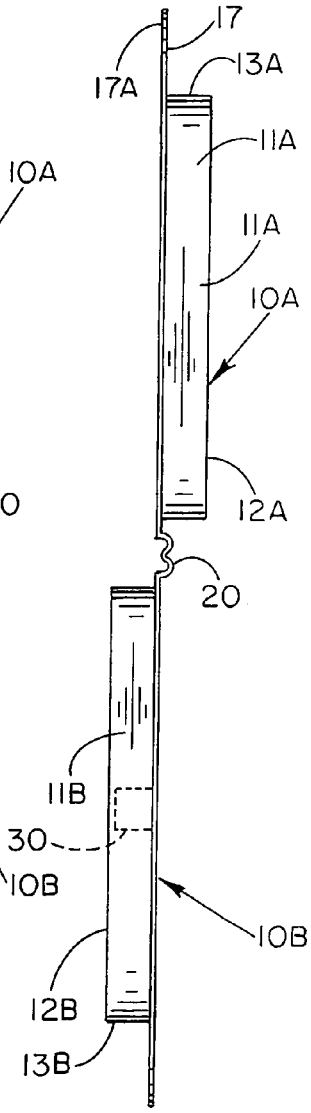
FIG. 7 is a side view of FIG. 6.
Figure 8:
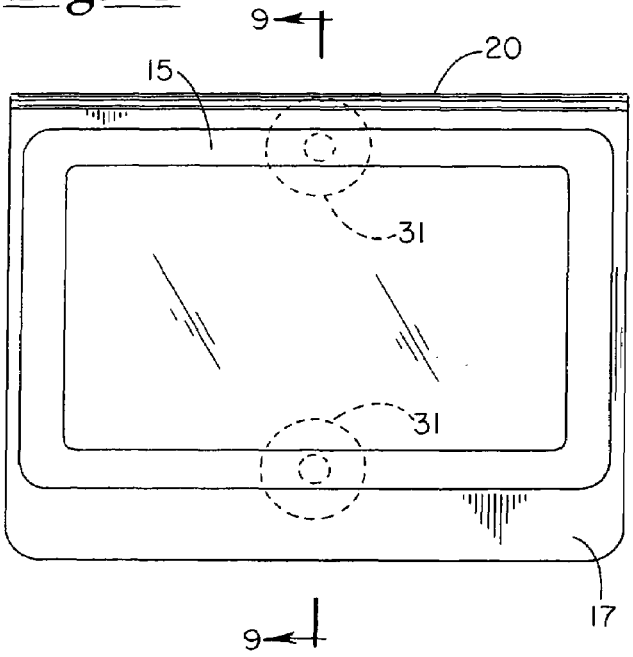
FIG. 8 is a plan or front view showing an embodiment of the invention other than as a gravesite marker in closed or use position.
Figure 9:
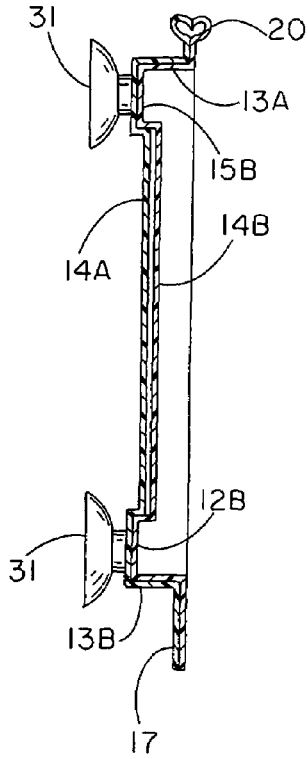
FIG. 9 is a sectioned view of FIG. 8.
Figure 10:
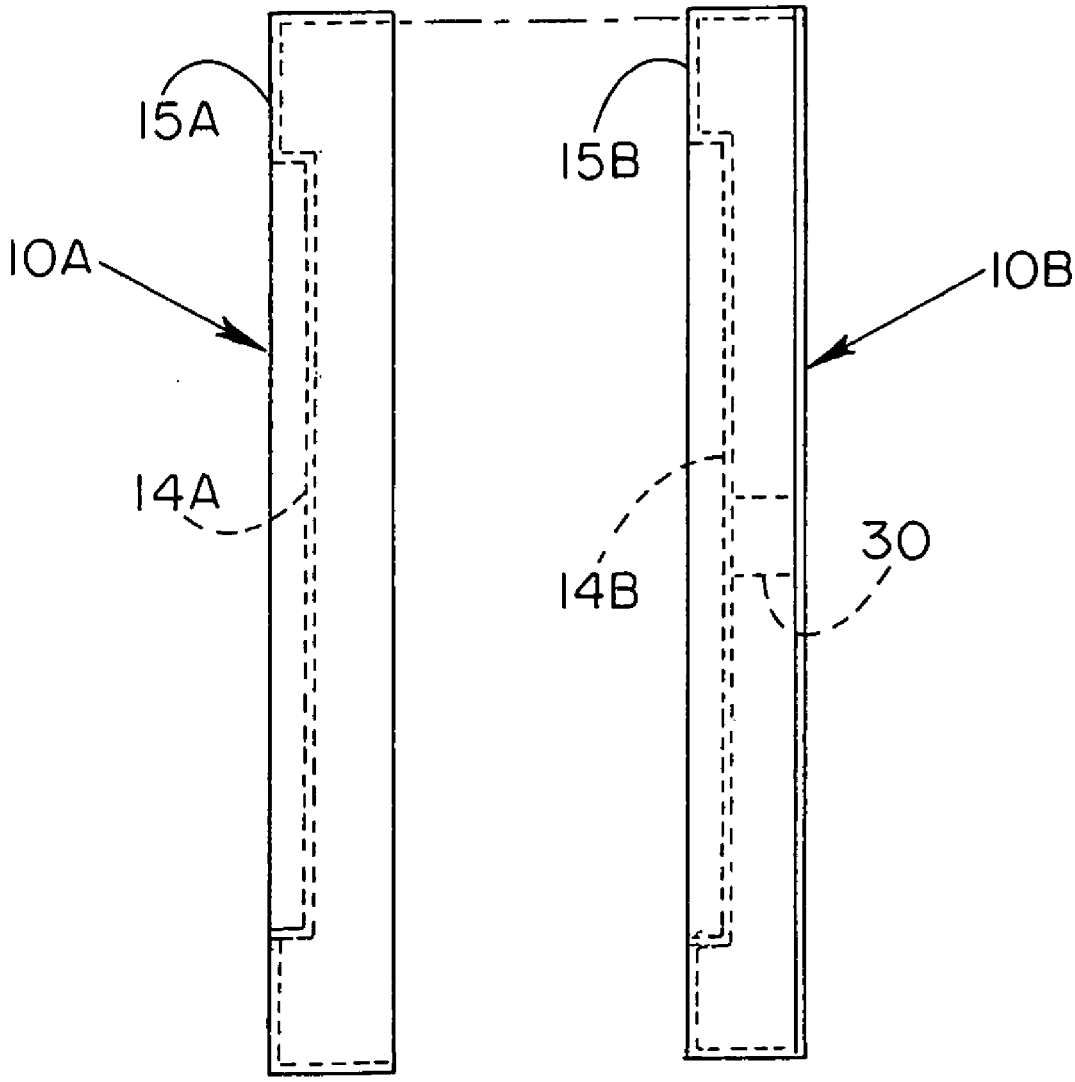
FIG. 10 is a side view illustrating another embodiment of the invention other than as a gravesite marker.

Alternatively, as in the embodiments illustrated in FIGS. 5 and 10, the two members 10A and 10B, may not be connected or attached to one another by a living hinge. In all other respects the display frame shown in FIG. 5 is the same as the above-described embodiment and functions the same and is used in the same manner with the same attendant benefits and features.

The embodiments, as illustrated in FIGS. 6–11, are similar to the embodiments in FIGS. 1–5 so the same reference numbers are used where there is duplication. One difference between the embodiments in FIGS. 6–11 and those in FIGS. 1–5 is that the former do not have a stake for insertion into the ground. Another difference is that the former may have magnets 30, see FIGS. 6 and 7, or suction cups 31, see FIGS. 8, 9 and 10, attached such as by a suitable adhesive so that the display frame can be mounted on or coupled to an upstanding supporting surface such as a vertical wall of a refrigerator or automobile or window or the like. Other commonly known coupling or mounting devices might be Velcro or double-sided adhesive tape. As a further feature, the frame area 15A and/or 15B may be decorated in some fashion to make the display even more attractive.

I claim:

1. A display frame comprising:

a pair of substantially similar members made of flexibly resilient transparent plastic, each member having a cavity defined by a generally planar face surrounded by an upstanding wall;

a living hinge attaching an edge of one member to an edge of the other member;

one member swingable about said living hinge for removable snug nesting into the cavity of the other member for holding planar display material between said planar faces.

2. The display frame as described in claim 1 further including a flange extending outward from the surrounding wall of each member, said flanges overlapping to form a barrier against outside weather elements when said one member is nested into the cavity of the other member.

3. The display frame as described in claim 1 wherein said members are generally rectangular.

4. The display frame as described in claim 1 further including means attached to one of the members for coupling the display frame to a supporting upstanding surface.

5. The display frame as described in claim 4 wherein said coupling means comprises a magnet.

6. The display frame as described in claim 4 wherein said coupling means comprises a suction cup.

7. The display frame as described in claim 1 wherein at least one of said cavity faces has a surrounding frame area within its surrounding wall.

8. A display frame comprising:

a pair of substantially similar members, each made of transparent flexibly resilient plastic, each member having a cavity defined by a planar face surrounded by an upstanding wall;

said members dimensioned such that one of the members is snugly removably nestable into the cavity of the other member for securely holding planar display material between said faces.

9. The display frame as described in claim 8 further including a flange extending outward from the surrounding wall of each member, said flanges overlapping to form a barrier against weather elements when one member is nested into the other member.

10. The display frame as described in claim 8 wherein said members are integrally formed with a living hinge attaching one member to the other member.

11. The display frame as described in claim 10 further including a flange extending outward from the surrounding wall of each member, said flanges overlapping to form a barrier against weather elements when one member is nested into the other member.

12. The display frame as described in claim 8 wherein said members are separate before nesting.

13. The display frame as described in claim 12 further including a flange extending outward from the surrounding wall of each member, said flanges overlapping to form a barrier against weather elements when one member is nested into the other member.

14. The display frame as described in claim 8 in which said members are generally rectangular.

15. The display frame as described in claim 8 further including means attached to one of the members for coupling the display frame to a supporting upstanding surface.

16. The display frame as described in claim 15 wherein said coupling means comprises a magnet.

17. The display frame as described in claim 15 wherein said coupling means comprises a suction cup.

18. The display frame as described in claim 8 wherein at least one of said cavity faces has a surrounding frame area within its surrounding wall.

19. A method for displaying information carried on a flat planar article, comprising the steps of:

a) providing a pair of substantially similar members made out of flexibly resilient transparent plastic, each member having a cavity defined by a generally planar face surrounded by an upstanding wall; then b) placing a flat planar display article at the face of one of the members; then c) snugly nesting a member into the cavity of the other member to bring the faces close together to firmly hold the display article between the members' faces.

20. A method for displaying information as described in claim 19 wherein said members each have a flange extending outward from an edge of the surrounding wall, said flange forming a barrier against weather elements when the members are snugly nested together.

* * * * *